US005304322A

United States Patent [19]

Kuse

[11] Patent Number: 5,304,322

[45] Date of Patent: Apr. 19, 1994

[54] CLEANING SOLVENT FOR AIRCRAFT HYDRAULIC FLUID

[75] Inventor: Ronald J. Kuse, Kent, Wash.

[73] Assignee: The Boeing Company, Seattle, Wash.

[21] Appl. No.: 888,992

[22] Filed: May 15, 1992

[51] Int. Cl.[5] ..... C11D 7/30; C11D 7/50; C23G 5/028; B08B 3/04

[52] U.S. Cl. ..... 252/172; 134/40; 134/42; 252/162; 252/364

[58] Field of Search ..... 252/162, 172, 364; 134/40, 42

[56] References Cited

U.S. PATENT DOCUMENTS

| | | | |
|---|---|---|---|
| 3,773,676 | 11/1973 | Boyles | 252/171 |
| 3,887,629 | 6/1975 | Fozzara | 570/178 |
| 4,174,295 | 11/1979 | Bargigia et al. | 252/364 |
| 4,803,842 | 2/1989 | Coelho et al. | 62/64 |
| 4,947,881 | 8/1990 | Magid et al. | 134/40 |
| 4,961,869 | 6/1990 | Eggers et al. | 252/170 |
| 4,981,879 | 1/1991 | Snider | 521/131 |
| 5,034,424 | 7/1991 | Wenning et al. | 521/131 |
| 5,055,138 | 10/1991 | Slinn | 134/11 |
| 5,108,637 | 4/1992 | Pearson | 252/67 |
| 5,190,029 | 3/1993 | Byron et al. | 252/305 |
| 5,210,106 | 5/1993 | Dams et al. | 252/182.24 |
| 5,211,873 | 5/1993 | Dams et al. | 252/182.24 |

FOREIGN PATENT DOCUMENTS

| | | | |
|---|---|---|---|
| 439283 | 7/1991 | European Pat. Off. . | |
| 465037 | 1/1992 | European Pat. Off. . | |
| 53-099469 | 8/1978 | Japan | 252/364 |
| 1-060694 | 3/1989 | Japan | 252/172 |
| 118167 | 5/1990 | Japan . | |
| 2-209833 | 8/1990 | Japan | 252/364 |
| 89/12674 | 12/1989 | World Int. Prop. O. | 252/172 |

OTHER PUBLICATIONS

Chemical Abstract No. 98(17):142837a abstract of Kruger et al *J. Solution Chem* 1982* 11(10) 719–28.

Chemical Abstract No. 103(2):12185x Abstract of Pozharskaya et al *Teplofiz, Svoista Metastab. Sist* 1984* 56–60.

*Primary Examiner*—Linda Skaling

*Attorney, Agent, or Firm*—Elizabeth F. Harasek; B. A. Donahue

[57] ABSTRACT

An environmentally compliant cleaning solvent for removing commercial aircraft hydraulic fluid comprises from about 25 to 35 volume percent perfluorocarbon with from about 4 to 8 carbons in the alkyl chain, from about 25 to 35 volume percent hydrochlorofluorocarbon with about 2 to 5 carbons in the alkyl chain; and the balance petroleum distillates with from about 5 to 9 carbons in the alkyl chain.

2 Claims, 1 Drawing Sheet

T=-20°F

T=32°F

CLEANING SOLVENT FOR AIRCRAFT HYDRAULIC FLUID

This invention relates to an environmentally compliant solvent for cleaning unwanted aircraft hydraulic fluid.

BACKGROUND 1,1,2-Trichloro-1,2,2-trifluoroethane or CFC-113, marketed by E. I. du Pont Nemours & Co. under the tradename Freon TF TM, by Allied Signal as Genesolv D TM and by Imperial Chemical Industries as Arklone P TM, has traditionally been specified and used by commercial aircraft producers to remove unwanted Type IV commercial aircraft hydraulic fluids from assembled airplanes and aircraft parts. However, the production and use of trichlorotrifluoroethane has been curtailed voluntarily and by law in an effort to reduce depletion of the earth's ozone layer. Production of trichlorotrifluoroethane will be eliminated by the year 1995. Accordingly, a new cleaning solvent for hydraulic fluids must be found.

Although I evaluated many commercially available single component solvents, solvent blends and cleaning mixtures, none complied with environmental regulations nor possessed all the requisite qualities of thorough, rapid and complete cleaning of hydraulic fluid; low toxicity; low flammability; high evaporation rate; wide operational temperature range; and compatibility with aircraft materials and systems. Accordingly, it was my object to invent a new solvent mixture with all these qualities.

BRIEF SUMMARY OF THE INVENTION

An environmentally compliant cleaning solvent for removing commercial aircraft hydraulic fluid comprises from about 25 to 35 volume percent perfluorocarbon with from about 4 to 8 carbons in the alkyl chain, from about 25 to 35 volume percent hydrochlorofluorocarbon with about 2 to 5 carbons in the alkyl chain; and the balance petroleum distillates with from about 5 to 9 carbons in the alkyl chain.

My invention will be better understood in terms of the figures and detailed description which follows.

DETAILED DESCRIPTION OF THE INVENTION

Figure 1:
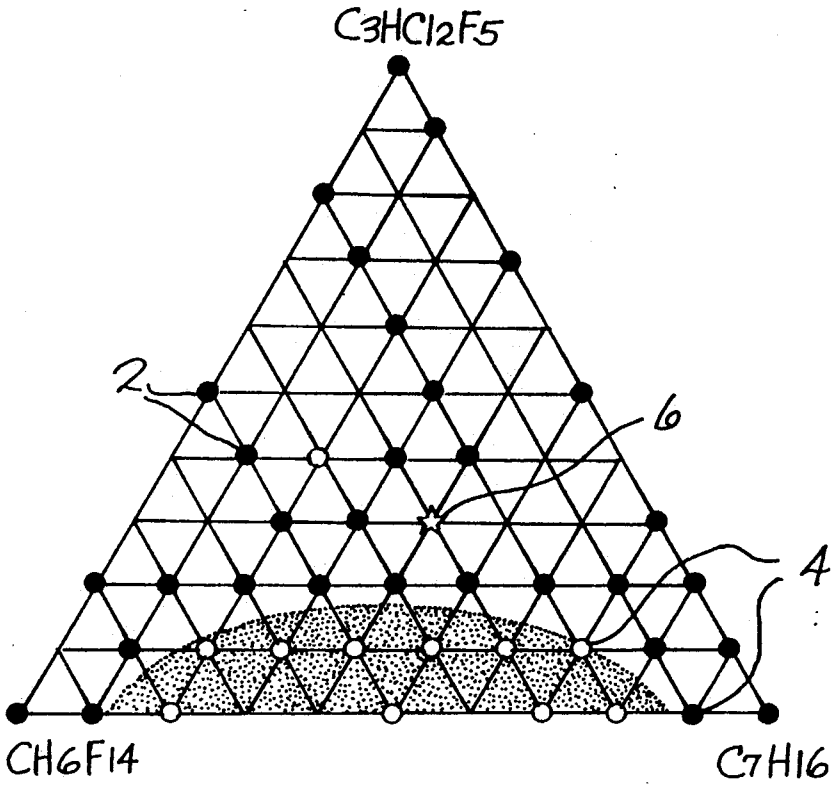
FIG. 1 is a ternary phase diagram for the subject solvent system at −20° F.

In accordance with a preferred embodiment of the invention, an environmentally compliant solvent blend for cleaning aircraft hydraulic fluid comprises from about 25 to 35 volume percent of a perfluorocarbon having about 4 to 8 carbons in the alkyl chain. The most preferred perfluorocarbon is $C_6F_{14}$. $C_6F_{14}$ is marketed by the 3M TM Company of St. Paul, Minn. as PF-5060 TM and Fluorinert TM FC-72.

The solvent blend also comprises from about 25 to 35 volume percent of a hydrochlorofluorocarbon having about 2 to 5 carbons in the alkyl chain. The most preferred hydrochlorofluorocarbons are pentafluorodichloropropanes, particularly mixtures of 1,1,1,2,2-pentafluoro-3,3-dichloropropane and 1,1,2,2,3-pentafluoro-1,3-dichloropropane. One such mixture is marketed by Asahi Glass Co., Ltd. of Tokyo, Japan, under the tradename Asahiklin AK-225 TM.

The advantage of the perfluorocarbon over trichlorotrifluoroethane is it does not catalyze ozone depletion reactions in the upper atmosphere. It is also negligibly reactive in the lower atmosphere and consequently does not contribute to the formation of photochemical smog. The advantage of the hydrochlorofluorocarbon over fully halogenated trichlorotrifluoroethane is that it reduces the ozone depletion potential by more than 95 percent.

The balance of the subject solvent blend comprises liquid hydrocarbons, preferably petroleum distillates with from about 5 to 9 carbons in the alkyl chain. A preferred distillate is normal heptane with naturally occurring amounts of byproducts such as 2- and 3-methylhexane; 2,3- and 3,3-dimethylpentane; 2,4- and 2,2-dimethylhexane; dimethylcyclopentane, methylcyclohexane, and ethylpentane. One such petroleum distillate is Exxsol TM Heptane marketed by the Exxon Chemical Company of Houston, Tex.

Novel features of this solvent blend include the desired properties of cleaning capability, acceptable environmental properties regarding ozone depletion and volatile organic compound vapor pressure, rapid evaporation, and relatively low toxicity. A low dielectric constant allows use of the blend even when an airplane's electrical systems are operating. The blend is stable at practical operating temperatures between about 120° and −20° F. and can be stored outdoors. The blend has no measurable flashpoint.

Cleanup of Type IV hydraulic fluid by the subject solvent blend is also novel as compared to prior cleaning solutions. When using trichlorotrifluoroethane, hydraulic fluid removal occurs by solvency and dilution. With the subject solvent blend, removal occurs by displacement wetting, solvency, extraction and dilution.

In the subject invention, hydraulic fluid is dissolved in the chlorofluoroalkane and petroleum distillate, both of which become partially extracted. Concurrent with this process, is displacement wetting of the substrate by the perfluorocarbon constituent. I believe that this process depends on the low interfacial tension of the perfluorocarbon and chlorofluoroalkane and equilibrium phase partitioning among all the solvent constituents and the hydraulic fluid. The combination of these processes and favorable system kinetics result in rapid and effective removal of hydraulic fluid.

Over 650 solvent and solvent mixtures were reviewed for compliance with the above mentioned criteria. The material groups examined included hydrocarbons derived from petroleum and agricultural feedstocks, alcohols, glycols, glycol ethers, esters, aldehydes, ketones, ethers, halogenated hydrocarbons, nitrogen compounds, sulfur compounds, silicone compounds and commercially available cleaning solutions. Of all the solvents tested, only those with the compositions set forth above were found to be acceptable regarding all criteria.

EXAMPLE

Figure 2:
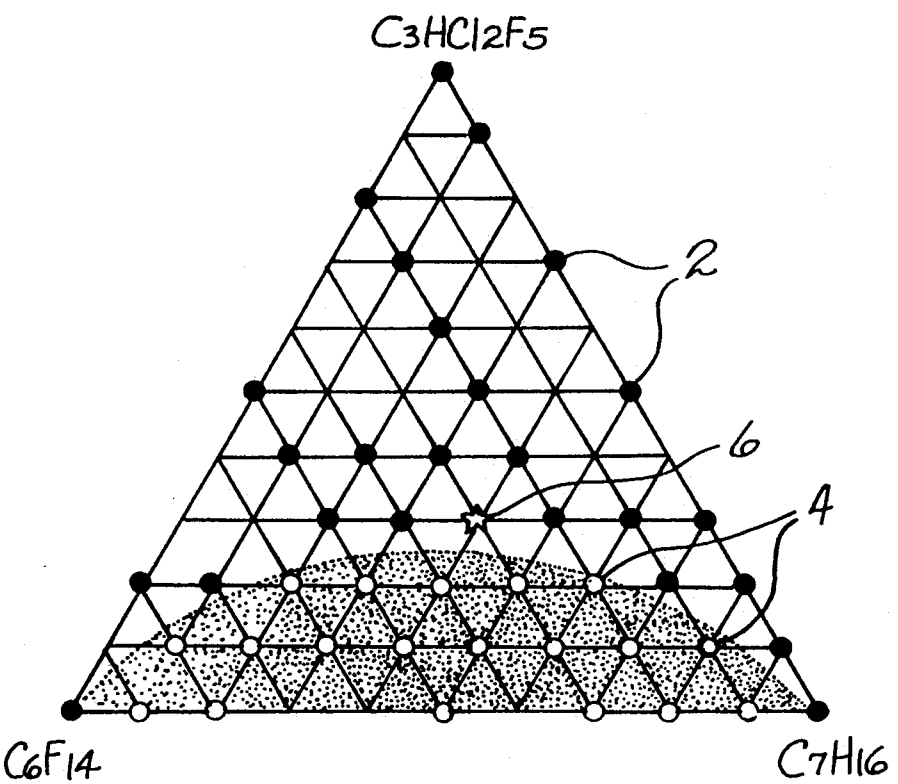
FIG. 2 is a ternary phase diagram for the subject solvent system at 32° F.

Referring to FIGS. 1 and 2, mixtures of $C_6F_{14}$, pentafluorodichloropropane and n-heptane were compounded in the proportion indicated by the filled circles 2, open circles 4, and stars 6 on the ternary phase diagrams. The shaded-in regions of FIGS. 1 and 2, show the compositional ranges in which a phase separation occurred between the pentafluorodichloropropane and other constitutents at temperatures of −20° F. and 32° F., respectively. Such phase separations, at compositions 4, for example, are unacceptable for use of the solvent. Stars 6 indicate the composition best found to meet or surpass all the requirements set out in the table below.

HYDRAULIC FLUID CLEANING SOLVENT BLEND PROPERTIES

| PROPERTY | REQUIREMENT | COMMENTS |
|---|---|---|
| Cleaning Performance | BAC 5750* | Performance in factory conditions verified |
| Materials Compatibility | D6-17487* Sandwich corrosion Acrylic crazing Paint softening Hydrogen embrittlement | |
| Temperature Stability | −20° F. < T < 120° F. | |
| Flammability | Flashpoint >200° F. | No flashpoint ASTM-D93 (Pensky-Martens Closed Tester) |
| Dielectric Constant | 2 < x < 7 | Estimated |
| Evaporation Rate | 75–125% of Trichlorotrifluoroethane | |
| ODP | <0.15 | 0.004–0.015 |
| VOC Vapor | <1.5 psia | <1.5 psia |

-continued

HYDRAULIC FLUID CLEANING SOLVENT BLEND PROPERTIES

| PROPERTY | REQUIREMENT | COMMENTS |
|---|---|---|
| Pressure | @ 70° F. | @ 70° F. |

*Boeing specification designation

In summary, I have invented an environmentally acceptable solvent blend for cleaning hydraulic fluid, the ozone depletion potential of which is more than 98 percent lower than that of the chlorofluorocarbon now used. While my invention has been described in terms of specific embodiments thereof, other forms may be readily adapted by one skilled in the art. Accordingly, the scope of my invention is to be limited only in accordance with the following claims.

I claim:

1. An environmentally compliant solvent blend for cleaning aircraft hydraulic fluid consisting essentially of from about 25 to 35 volume percent of $C_6F_{14}$; from about 25 to 35 volume percent pentafluorodichloropropane consisting essentially of one or more constituents selected from the group consisting of 1,1,1,2,2-pentafluoro-3,3-dichloropropane and 1,1,2,2,3-pentafluoro-1,3-dichloropropane; each said halogenated hydrocarbon substantially not catalyzing ozone depletion reactions in the upper atmosphere, and the balance normal heptane with naturally occurring amounts of one or more distillation byproducts selected from the group consisting of 2-methylhexane; 3-methylhexane; 2,3-dimethylpentane; 3,3-dimethylpentane; 2,4-dimethylhexane; 2,2-dimethylhexane; dimethylcyclopentane, methylcyclohexane, and ethylpentane.

2. The solvent blend of claim 1, wherein no phase separation of the constituents occurs at temperatures of about −20° F. and 32° F.

* * * * *